US005956870A

United States Patent [19]

Grossman et al.

[11] Patent Number: 5,956,870

[45] Date of Patent: Sep. 28, 1999

[54] SHOES WITH RETRACTABLE SPIKES AND METHOD FOR USE THEREOF

[76] Inventors: Gerald Grossman, 6100 Westchester Park Dr. Suite 1019, College Park, Md. 20740; Thomas Roney, 1749 Connecticut Ave., Marysville, Mich. 48040

[21] Appl. No.: 08/963,249

[22] Filed: Nov. 3, 1997

[51] Int. Cl.[6] ..... A43B 5/00; A43C 15/00

[52] U.S. Cl. ..... 36/127; 36/61; 36/15

[58] Field of Search ..... 36/15, 61, 134, 36/127

[56] References Cited

U.S. PATENT DOCUMENTS

| | | | |
|---|---|---|---|
| 788,160 | 4/1905 | Leadbeater | 36/15 |
| 1,304,616 | 5/1919 | Smith . | |
| 1,487,976 | 3/1924 | Rossi et al. | 36/61 |
| 1,702,800 | 2/1929 | Silvey | 36/15 |
| 3,538,628 | 11/1970 | Einstein, Jr. | 36/15 |
| 3,693,269 | 9/1972 | Guarrera | 36/15 |
| 4,375,729 | 3/1983 | Buchanen, III . | |
| 4,377,042 | 3/1983 | Bauer | 36/15 |
| 4,578,883 | 4/1986 | Dassler . | |
| 4,716,664 | 1/1988 | Taylor . | |
| 4,825,562 | 5/1989 | Chuang . | |
| 4,866,861 | 9/1989 | Noone . | |
| 4,875,683 | 10/1989 | Wellman et al. . | |
| 5,243,776 | 9/1993 | Zelinko . | |
| 5,345,701 | 9/1994 | Smith | 36/127 |
| 5,392,537 | 2/1995 | Goldberg | 36/61 |
| 5,410,821 | 5/1995 | Hilgendorf | 36/15 |
| 5,497,565 | 3/1996 | Balgin . | |
| 5,526,589 | 6/1996 | Jordan . | |
| 5,542,198 | 8/1996 | Famolare | 36/15 |

FOREIGN PATENT DOCUMENTS

| | | | |
|---|---|---|---|
| 1261017 | 2/1968 | Germany | 36/61 |
| 2008088 | 8/1971 | Germany | 36/61 |

*Primary Examiner*—M. D. Patterson

[57] ABSTRACT

A shoe has spikes that can be retracted merely by moving an external operating member. Replaceable lower sole members can be selected and attached to the shoe based on ground surface conditions. Also, a shoe package includes one shoe with spikes and one shoe with retractable spikes or without spikes. A method of swinging a golf club using the shoe package permits a golfer's rear foot to be firmly planted while allowing the golfer's front foot to rotate and glide thus facilitating proper follow through.

7 Claims, 4 Drawing Sheets

SHOES WITH RETRACTABLE SPIKES AND METHOD FOR USE THEREOF

RELATED APPLICATION DATA

This application is related to Applicant's copending application Ser. No. 08/812,162 filed on Mar. 6, 1997, the disclosure of which is incorporated herein by reference.

BACKGROUND OF THE INVENTION

1. Field of the Invention

The invention relates to shoes having retractable spikes and, more particularly, to shoes having spikes that are easily retractable for facilitating swinging a golf club and a method of using the shoes.

2. Description of the Related Art

In executing a golf swing correctly, it is important that the golfer end up facing the target. Unfortunately, most golfers cannot successfully make this movement when they are wearing a standard pair of spiked golf shoes because the spikes of the shoes root their feet to the ground. Restraining movement of the golfer's front foot makes it difficult for the average golfer to make the proper turn during the golf swing so that his body is properly facing the target at the end of the swing.

As a result of not being able to make the proper turn through the ball with the body facing the target at the end of the golf swing, the hips and shoulders of the golfer "pile up" and the golfer is not able to deliver the power of the big muscles of the back and shoulders in the desired manner. In addition, when the hips and shoulders "pile up," tremendous strain is placed on the ankles, knees, front hip and back of the golfer. This results in many injuries of varying degree each year.

During the golf swing there should also be a translational component of motion during the downswing, and conventionally spiked golf shoes which have the purpose of firmly rooting the golfer to the ground do not permit this translational component of motion. As a result, the average golfer is forced to make an unbalanced follow-through with improper weight transfer to the forward foot.

Various modifications to conventional spiked golf shoes have been attempted to enable a golfer to make the proper movements during the golf swing without injury. For example, U.S. Pat. Nos. 1,304,616 and 5,243,776 describe golf shoe constructions which are provided with pivoted spike-supporting plates. The golfer wears the shoes on each foot so that both feet are permitted to rotate during the golf swing.

Unfortunately, if both feet of the golfer are permitted to rotate during the golf swing, a proper swing does not result. This is because it is important for the golfer's rearward foot to remain firmly positioned during the backswing so that resistance and forces are built-up by the coiling action of the golfer's torso and arms around the rear leg. This storing of energy on the backswing is not facilitated by use of the shoes described in the patents noted above because the entire body and legs of the golfer are able to rotate. As a result, the necessary tension and coiling potential would not be created between the golfer's torso and arms and his rearward leg during the backswing. Also, the shoes disclosed in the '616 and '776 do not permit the golfer's front foot to have a translational component of motion.

Additionally, the use of retractable spikes in various shoes is known. For example, U.S. Pat. No. 4,375,729 describes a shoe having retractable spikes for use on snow or ice. A cam moves longitudinally within a hollow sole to move the spikes into a projecting position and to withdraw the spikes into a retracted position. A control for moving the cam is accessible through a flexible wall at the rear of the heel of the shoe. Therefore, the user must bend down, lift the shoe and balance on one foot, or remove the shoe, to change the status of the spikes.

U.S. Pat. No. 4,825,562 discloses a shoe for use in snow or ice having retractable spikes that are manipulated by a rotary dial. The dial is accessed from inside the shoe, and thus the shoe requires either a highly flexible insole so that the handle of the dial may be grasped through the insole, or requires that the insole be partially removed. In either configuration, the shoe must be removed to access the dial.

U.S. Pat. No. 5,526,589 discloses a shoe having retractable spikes and an inflatable bladder which causes the spikes to retract when inflated. A pump and an exhaust air valve are disposed within the upper of the shoe for inflating and deflating the bladder thus requiring that the user lift the shoe and balance on one foot, remove the shoe, or bend over the operate the pump manually. Also, the pump must be operated several times to retract the spikes.

U.S. Pat. No. 5,497,565 also discloses a shoe having retractable spikes. The spikes are coupled to a complex motion translation device to change from a retracted state to a projecting state in response to manual rotation of a knob on the back of the heel of the shoe; thus also requiring that the user bend down, balance on one foot, or remove the shoe, to change the status of the spikes. Also, the knob must be rotated through a large angular displacement to move the spikes through a full stroke.

It is, therefore, an object of the present invention to readily enable the golfer to complete the follow-through during the golf swing so that the golfer's body is properly facing toward the target at the end of the golf swing.

Another object of the invention is to permit the rearward foot of the golfer to remain firmly rooted and fixed in position with respect to the ground during the backswing but permit the forward foot of the golfer to slidably rotate with respect to the ground during the follow-through of the golf swing.

A further object of the invention is to enable the golfer's forward foot to have a translational component of motion during the golf swing.

Still another object is to simplify maintenance in the manufacture of a pair of shoes for use by golfers.

A still further object of the invention is to reduce golf related injuries.

Yet another object of the invention is to enable a golfer to deliver the power of the big muscles of the back and shoulders in the most effective manner during the golf swing.

Still another object of the invention is to allow the golfer's body parts to turn freely during the golf swing.

Another object of the invention is to permit a golfer to selectively retract or extend spikes of at least one golf shoe with minimal effort.

It is also an object of the invention to provide retractable spikes on the sole over a large area, while requiring only one operating member to control all spikes.

A still further object of the invention is to enable projection and retraction of spikes without requiring the wearer to bend over to operate controls by hand or remove the shoe.

Still another object of the invention is to provide ground engaging surfaces of the shoe which are appropriate for various ground conditions.

The above objects are attained by a pair of golf shoes in which at least one of the shoes has retractable spikes. In one aspect of the invention the shoe has a chamber formed in the sole. A rotary cam member is disposed in the chamber and when rotated to a first position, forces spikes to project through openings in the sole. When the cam member is rotated to a second position, the spikes retract into the sole. A control lever for rotating the cam projects laterally to the exterior of the sole. The control lever can be operated and thus the spikes can be retracted or projected, by moving the shoe along the ground or other surface in a predetermined manner.

This construction permits appropriate body movement, thereby improving accuracy, enabling full muscular effort to be achieved, and mitigating strain imposed upon the body. Also, a significant portion of sole area may be devoted to bearing weight. Further, the shoe need not be removed to project and retract spikes. The lever may be moved by sliding the side of the shoe against the ground or other surface.

In another aspect of the invention replaceable lower sole members are provided on the shoes. The lower sole members have surface characteristics appropriate for different ground conditions, such as dry, wet, or normal. The appropriate lower sole member is selected based on conditions of a playing surface.

Another aspect of the invention is a method of swinging a golf club while wearing at least one shoe with retractable spikes comprising the steps of retracting the spikes of a shoe worn on the front foot, swinging the golf club, and subsequently causing the spikes to project again.

Another aspect of the invention is a method of retracting the spikes of a shoe comprising, rotating the shoe about the wearer's ankle, engaging an operating member of the shoe with the ground, and sliding the shoe relative to the ground to move the operating member and cause a retraction device in the shoe to retract the spikes.

Another aspect of the invention is a shoe package including a container, a first shoe disposed in the container and having a plurality of spikes, and a second shoe disposed in the container and having a smooth spikeless sole.

BRIEF DESCRIPTION OF THE DRAWING

The invention will be described through preferred embodiments and the attached Figures in which.

DETAILED DESCRIPTION OF THE PREFERRED EMBODIMENT

Figure 1:
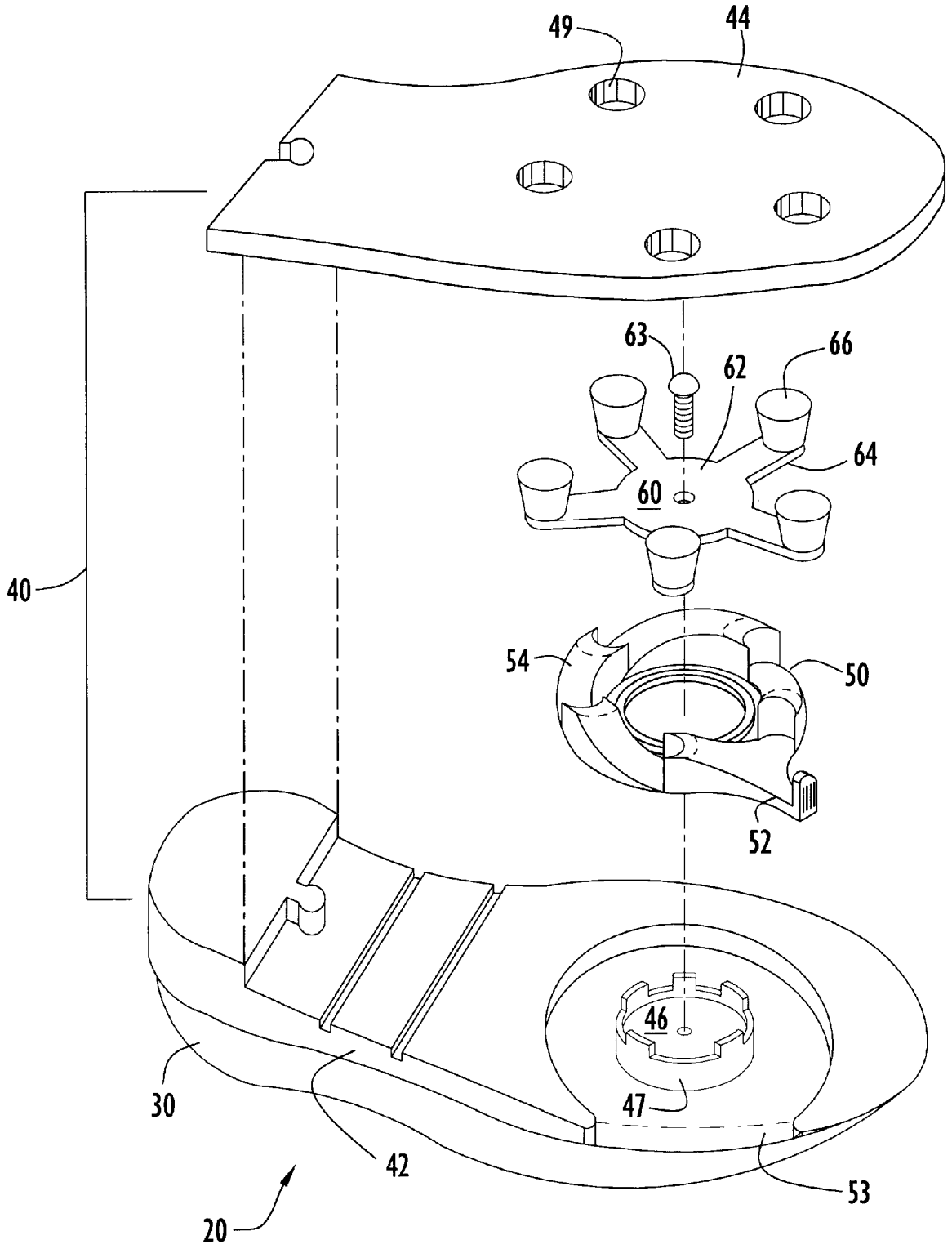
FIG. 1 is an exploded perspective view of a shoe in accordance with the invention.
Figure 2:
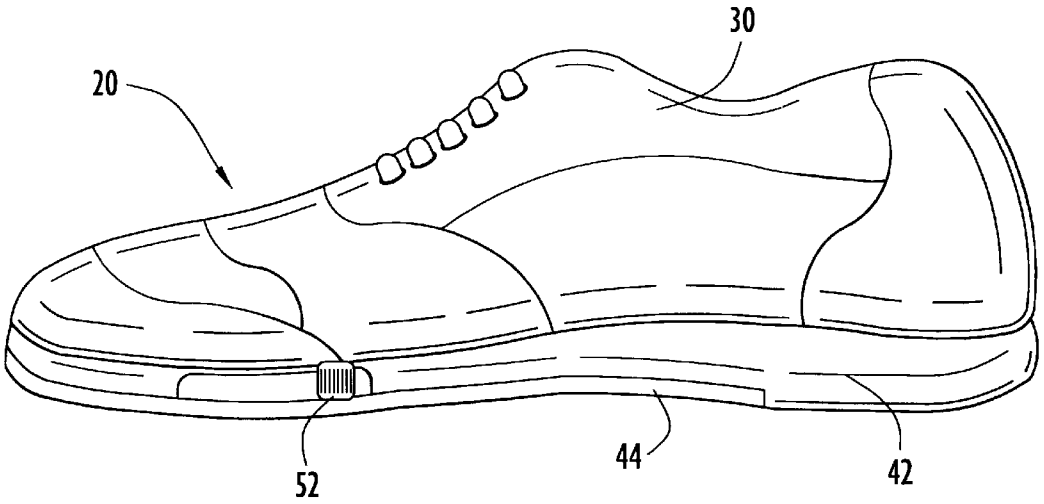
FIG. 2 is a side view of the shoe of FIG. 1 with spikes retracted.
Figure 3:
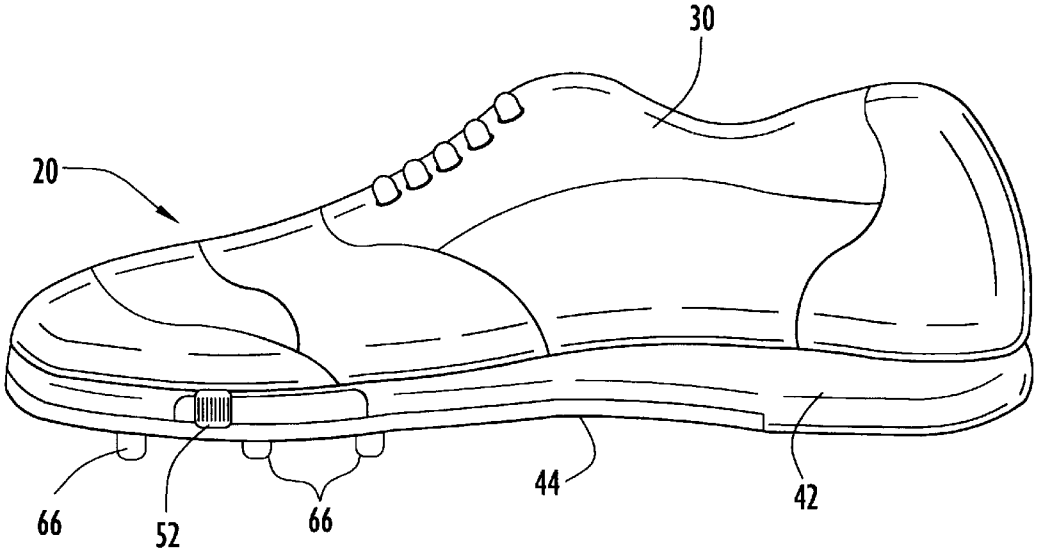
FIG. 3 is a side view of the shoe of FIG. 1 with spikes extended.

A shoe in accordance with the invention is illustrated in FIGS. 1–3. Shoe 20 includes upper 30, and sole 40 which includes upper sole member 42 and lower sole member 44. Note that, in FIG. 1, the bottom of the shoe faces upward for clarity and thus lower sole member 44 is above upper sole member 42 in FIG. 1. Upper 30 is similar to a conventional shoe upper, made of leather or the like, defines a cavity therein for receiving the wearers foot, and can include laces or other fit adjustment mechanisms. Sole 40 is disposed on a lower surface of upper 30. Upper sole member 42 is disposed on a lower surface of upper 30 and can be attached thereto in a permanent manner by adhesives or the like. Upper sole member 42 includes a heel. A tread surface can be defined on the heel to facilitate traction on smooth indoor floors or other hard surfaces.

As best illustrated in FIG. 1, a circular cavity is defined in upper sole member 42 at a position corresponding to a front portion of the wearer's foot. Disk 46 is fixedly disposed in the cavity defined in upper sole member 42. Disk 46 has annular extending portion 47 to define a central space in disk 46. Notches are formed at regular intervals around extending portion 47. Cam member 50 is also disposed in the cavity and has a central hole therein that receives disk 46 to permit cam member 50 to be rotated about disk 46 while fixing the position of cam member 50 in axial directions. Cam member 50 includes an integral operating member, in the form of lever 52, that extends through an opening formed in a side portion of upper sole member 42 as best shown in FIGS. 2 and 3.

Resilient member 60 includes central portion 62 and resilient portions in the form of radial arms 64 extending from central portion 62 in a cantilever manner. At least one spike 66 (only one of which is indicated) is disposed on a free end of each radial arm 64. Central portion 62 fits snugly into the central space defined by extending portion 47 of disk 46 and radial arms 64 each extend through a respective one of the notches formed in extending portion 47 of disk 46 to prevent rotation of resilient member 60. During assembly of shoe 20, cam member 50 is fitted over disk 46 and then resilient member 60 is fitted on disk 46 in the manner described above. Screw 63, or another attaching member, can be used to secure resilient member 60, and thus cam member 50, to disk 46. Subsequently, lower sole member 44 is affixed on a lower surface of upper sole member 44, by adhesive or the like, to enclose the cavity formed in upper sole member 42 and containing disk 46, cam member 50, and resilient member 60. A plurality of openings 49 are formed in lower sole member 44 and correspond in size and position to respective spikes 66.

As illustrated in FIG. 1, radial arms 64 each lie over one of a plurality of cam surfaces 54 (only one of which is indicated) defined on cam member 50. Each cam surface 54 is essentially a ramp that extends downward, i.e. away from upper 30. When cam member 50 is rotated to a first position, i.e. an extended position, radial arms 64 lie on the extended most portion of each cam surface 54 and radial arms 64 are pushed downward, i.e. away from upper 30, thereby causing spikes 66 to extend through respective ones of openings 49, as illustrated in FIG. 3. This state of the spikes is referred to as the "extended position" herein. When cam member 50 is rotated to a second position, i.e. a retracted position, radial arms 64 lie on the recessed most portion of each cam surface 54 and radial arms 64 are pulled upward, i.e. towards upper 30, due to the resilience of radial arms 64, thereby causing spikes 66 to retract to an extent that spikes 66 do not protrude through openings 49, as illustrated in FIG. 2. This state of the spikes is referred to as the "retracted position" herein.

Figure 6:
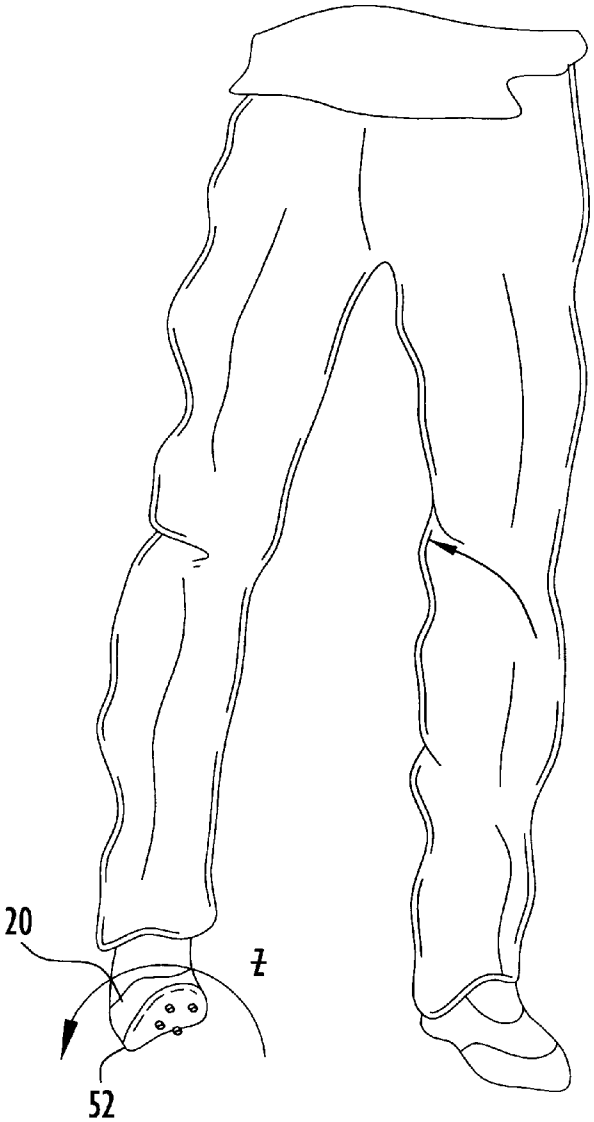
FIG. 6 is a perspective view of a wearer changing spike status.

As noted above, lever 52 extends through an opening in upper sole member 42. Seal 53 (indicated by a dotted line in FIG. 1) can be disposed in the opening to prevent dirt, water, or the like, from entering the cavity. After assembly of shoe 20, lever 52 extends out of a side portion of shoe 20 as best illustrated in FIGS. 2 and 3. Preferably lever 52 extends to an extent that does not interfere with normal walking and other activities to be accomplished in the shoes but extends enough to permit lever 52 to be engaged with the ground or other convenient surface, such as a wall or the like. As illustrated in FIG. 6, the wearer need only rotate shoe 20 about the ankle in the direction indicated by Arrow Z to permit the free end of lever 52 to engage the ground. Subsequently, shoe 20 can be moved linearly forward or backward (i.e. into or out of the page in FIG. 6) to move lever 52, rotate cam member 50, and thereby selectively switch spikes 66 between the extended and retracted positions described above.

Figure 4:
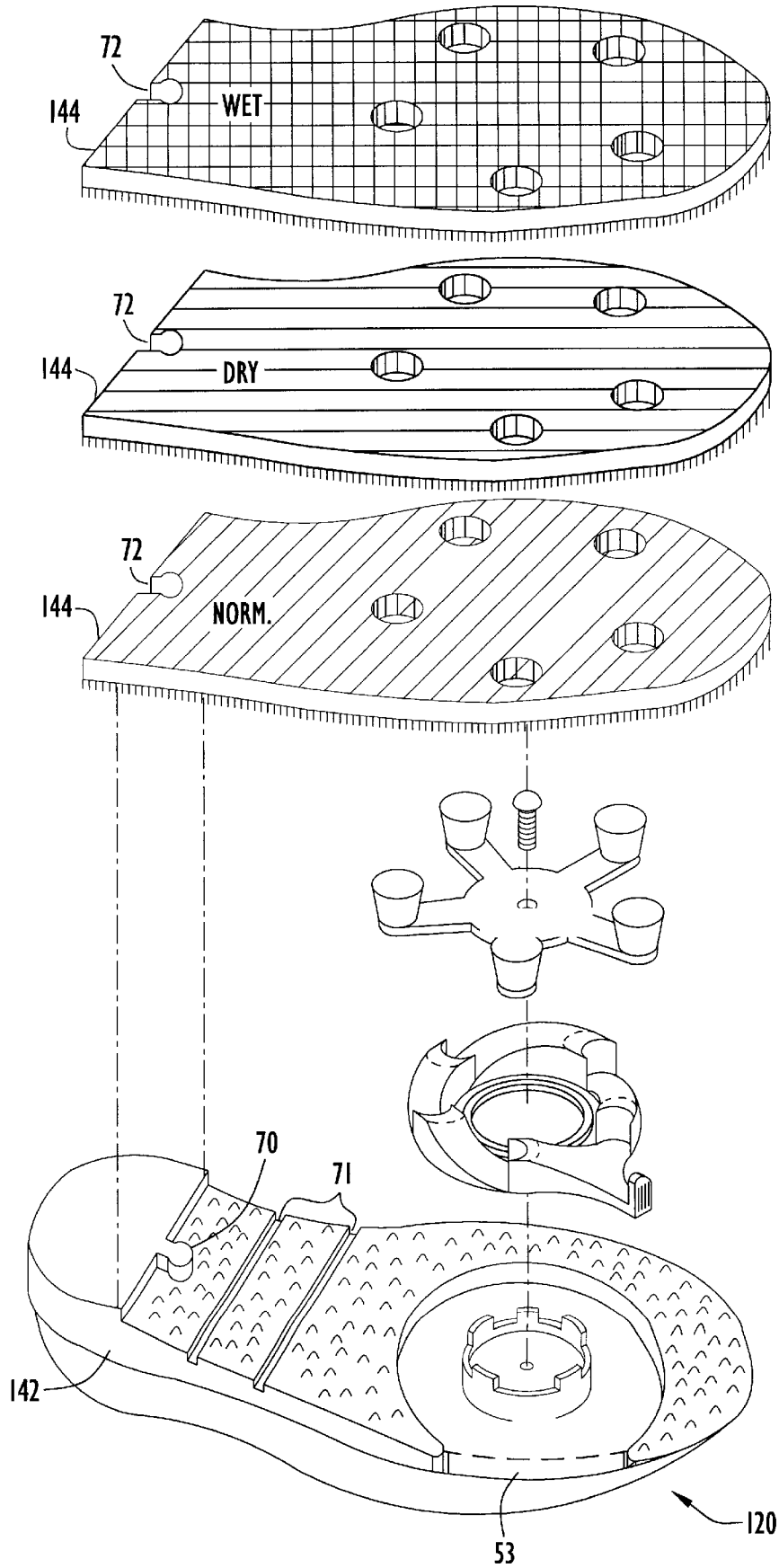
FIG. 4 is an exploded perspective view of another shoe in accordance with the invention.

Another shoe 120 is illustrated in FIG. 4. Shoe 120 is similar to shoe 20 described above except that shoe 120 has plural replaceable lower sole members 144 that can be interchanged based on the wearers experience and preference as well as ground conditions. In particular, upper sole member 142 has one portion of a hook and loop type fastener on a lower surface thereof and each lower sole member 144 has the other portion of the hook and loop fastener on an upper surface thereof Projection 70 is formed on a rear portion of upper sole member 142 near the heel. A corresponding recess 72 is formed in each lower sole member 144 to receive projection 70. This facilitates proper positioning of lower sole member 144 and provides increased stability to resist lateral movement of lower sole member 144 relative to upper sole member 142. Grooves 71 and corresponding extending ridges (not show) can also be provided to facilitate positioning. Additional projections and recesses can be provided as needed to properly position and maintain lower sole member 144 on upper sole member 142.

A plurality of lower sole members 144 can be provided with different tread patterns, coefficients of friction with respect to grass, or other characteristics, and the desired lower sole member can be attached to upper sole member 142 based on the surface conditions or experience of the wearer. For example, the inventor has discovered that it is desirable to use a lower sole member that yields a coefficient of friction with the ground surface that is between 0.05 and 0.30 inclusive. Both shoes can have replaceable lower sole members and different lower sole members can be applied to each shoe if desired. Of course, the replaceable lower sole member can be provided on only one shoe if desired. Further the replaceable lower sole member can be applied to a shoe without spikes or with retractable spikes. In fact, the replaceable lower sole member can itself have spikes formed thereon on place of, or supplementary to, retractable or nonretractable spikes on the shoe. The various lower sole members can be color coded or have written indicia thereon to facilitate selecting the desired lower sole member for use. For example, labels such as "dry", "wet", and "normal" can be disposed on respective lower sole 144 members as illustrated.

During use, retractable spikes are ordinarily provided on the front shoe, i.e. the left shoe of a right-handed golfer and the right shoe of a left-handed golfer. Prior to swinging the golf club, the spikes on the front shoe are retracted in the manner described above. This permits proper follow through on the swing in which the front foot easily rotates and goes through translational motion. Subsequent to swinging the club, the spokes can be extended again for improved traction while walking. In the case of replaceable lower sole members, the desired lower sole member is selected based on conditions and placed on the shoe prior to swinging the club. Other operations of such a shoe are the same.

Figure 5:
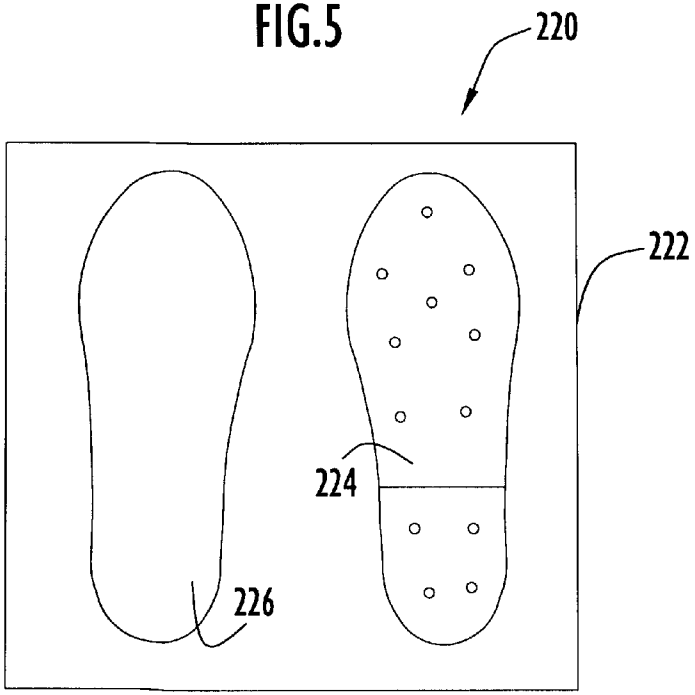
FIG. 5 is a schematic illustration of a shoe package according to the invention.

A shoe package 220 according to the invention is illustrated in FIG. 5. Shoe package 220 includes container 222, first shoe 224, and second shoe 226. First shoe 224 is a conventional shoe with spikes to be worn on the golfer's rear foot. Second shoe 226 can be a spikeless shoe or a shoe with retractable spikes as disclosed above. The shoe 224 is worn on the golfer's rear foot and second shoe 226 is worn on the front foot.

From the above, it can be seen that the invention improves a golfer's swing by facilitating proper follow through and by providing the desired degree of frictional coefficient between the shoes, particularly the front shoe, and the ground surface. The invention permits the spikes to be retracted or extended without bending down or removing the shoe. Typically, the front shoe, e.g. the left shoe for right-handed golfers, will have the spikes retracted or absent while swinging. However, the rear shoe can also be adjusted if desired. For example, the spikes can be caused to protrude to varying degrees depending on ground conditions and the experience level of the golfer.

Further, the invention can be applied to any activity where it may be desirable to adjust the amount of traction of a shoe. For example, the invention can be applied to other sports and the spikes can be selectively retracted to desired degrees. Also, the invention permits the same shoes to be worn on soft surfaces, such as grass, and hard surfaces, such as cement, without damaging the spikes.

The mechanism disclosed above for retracting the spikes is merely exemplary and any mechanism can be used. Also, any attachment mechanism for attaching the replaceable lower sole members can be used. For example, various screws, clips, pin and recess configurations, or the like can be used. Also, the resilient member supporting the spikes can be of any configuration to provide the desired spike spacing and positions. For example, leaf springs, coil springs, or the like can be used. There can be more than one resilient member and more than one cam member or other device for causing the spikes to retract and extend. For example, there can be two resilient members and two rotatable cam members that are geared to one another to rotate together to retract and extend the spikes in response to movement of one operating member, such as a lever. Additionally, the operating member can be of any desired configuration, such as a button, a rotating dial, a slide member or the like. Also, the operating member can protrude from any desired portion of the shoe.

Although the present invention is advantageous for golf, it may be employed for other athletic endeavors. When devoted to golf, only one shoe may be provided with the novel retractable spikes, the other shoe of each pair being of solid sole construction. Alternatively, both shoes of a single pair may have retractable spikes. The latter embodiment of the invention is not only potentially suitable for different sports, but enables a single pair of shoes to accommodate both right handed and left handed golfers. This characteristic enables production runs and stocking requirements for retail outlets to be limited.

The embodiments disclosed above are exemplary and are not limiting to the invention as defined by the appended claims.

What is claimed is:

1. A shoe having retractable spikes, comprising:

an upper for receiving a foot of the wearer;

a sole disposed on a lower surface of said upper;

at least one spike;

a retraction mechanism disposed in a cavity defined in said sole and coupled to said at least one spike and configured to move between a retracted position, wherein said at least one spike does not protrude from said sole, and an extended position, wherein said at least one spike protrudes from said sole, said retraction mechanism including a rotatable cam member having a plurality of cam surfaces defined thereon, and a resilient member having a stationary central portion and a plurality of resilient portions extending from said central portion, each of said resilient portions supporting at least one of said spikes and each of said resilient portions being coupled to a respective one of said cam surfaces; and an operating member coupled to said retraction mechanism and configured to move said retraction mechanism between the retracted position and the extended position whereby movement of said operating member causes said cam member to rotate whereby said cam surfaces move relative to said resilient portions to thereby flex said resilient portions and cause said retraction mechanism to move between the retracted position and the extended position.

2. A shoe as recited in claim 1, wherein said operating member is a lever extending from said cam member to an exterior of the shoe.

3. A shoe as recited in claim 1, wherein a spike is disposed on a free end of each of said resilient portions.

4. A shoe as recited in claim 3, further comprising a disc member disposed in a cavity defined in said upper sole member and having an annular extending portion which defines a central open space, said annular extending portion having notches formed therein at regular angular intervals, said cam member being disposed around said disc member and said central portion of said resilient member being disposed in said central open space, said resilient portions extending through said notches.

5. A shoe as recited in claim 3, further comprising a seal member disposed in an opening through which said operating member extends.

6. A shoe as recited in claim 1, wherein said sole comprises an upper sole member having a heel fixedly attached to said upper, a lower sole member, and means for removably attaching said lower sole member to a lower surface of said upper sole member, and further comprising a projection extending from said upper sole member proximate said heel, said lower sole member having a recess adapted to receive said projection when said lower sole member is attached to said upper sole member to thereby align said lower sole member relative to said upper sole member.

7. A shoe as recited in claim 6, further comprising a hook and loop fastener disposed between said upper sole member and said lower sole member to attach said lower sole member to said upper sole member.

* * * * *